US008887838B2

(12) United States Patent
Stowe, II

(10) Patent No.: US 8,887,838 B2
(45) Date of Patent: Nov. 18, 2014

(54) CUTTING ELEMENT AND METHOD OF ORIENTING

(75) Inventor: Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 325 days.

(21) Appl. No.: 12/700,845

(22) Filed: Feb. 5, 2010

(65) Prior Publication Data

US 2011/0192653 A1 Aug. 11, 2011

(51) Int. Cl.
*E21B 10/46* (2006.01)

(52) U.S. Cl.
CPC ..... *E21B 10/46* (2013.01)
USPC ..... 175/430; 175/428; 175/401; 175/57; 166/376

(58) Field of Classification Search
USPC ..... 175/376, 398, 401, 426, 430, 431, 57; 407/113–117, 102–109; 30/353, 357; 166/376
See application file for complete search history.

(56) References Cited

U.S. PATENT DOCUMENTS

| | | | | |
|---|---|---|---|---|
| 6,464,434 | B2 | 10/2002 | Lynde | |
| 6,672,406 | B2 | 1/2004 | Beuershausen | |
| 7,048,080 | B2 | 5/2006 | Griffo et al. | |
| 7,121,772 | B2 | 10/2006 | Krahula et al. | |
| 7,363,992 | B2 | 4/2008 | Stowe et al. | |
| 7,377,340 | B2 | 5/2008 | McDonough | |
| 7,543,661 | B2 | 6/2009 | Griffo et al. | |
| 7,703,559 | B2 * | 4/2010 | Shen et al. | 175/432 |
| 8,434,572 | B2 | 5/2013 | Stowe, II et al. | |
| 2002/0139582 | A1 | 10/2002 | Caraway et al. | |
| 2003/0031520 | A1 * | 2/2003 | Hintze et al. | 407/114 |
| 2004/0129420 | A1 * | 7/2004 | Hart et al. | 166/298 |
| 2005/0047885 | A1 * | 3/2005 | Hyatt et al. | 409/132 |
| 2005/0178587 | A1 | 8/2005 | Witman, IV et al. | |
| 2005/0284659 | A1 | 12/2005 | Hall et al. | |
| 2007/0107940 | A1 | 5/2007 | Lockstedt et al. | |
| 2007/0169937 | A1 | 7/2007 | Allin et al. | |
| 2007/0267221 | A1 | 11/2007 | Giroux et al. | |
| 2007/0278017 | A1 | 12/2007 | Shen et al. | |
| 2008/0142270 | A1 | 6/2008 | Haglund | |
| 2008/0164071 | A1 * | 7/2008 | Patel et al. | 175/431 |
| 2008/0264690 | A1 | 10/2008 | Khan et al. | |
| 2009/0032307 | A1 | 2/2009 | Meyer et al. | |
| 2009/0260878 | A1 | 10/2009 | Morley et al. | |
| 2009/0283326 | A1 | 11/2009 | Oothoudt | |
| 2011/0192653 | A1 | 8/2011 | Stowe, II | |

(Continued)

FOREIGN PATENT DOCUMENTS

JP 09150304 A 6/1997

OTHER PUBLICATIONS

Cutting & Wear—Hardfacing & Engineering for the Energy Industry; "Materials, equipment and services for oil companies"; Product Catalog; www.cwuk.com, South Yorkshire, United Kingdom.

(Continued)

*Primary Examiner* — Nicole Coy
*Assistant Examiner* — Taras P Bemko
(74) *Attorney, Agent, or Firm* — Cantor Colburn LLP

(57) ABSTRACT

A cutting element includes, a gilmoid with a plurality of cutting edges thereon, and at least one support extending from the gilmoid. The at least one support and at least one of the plurality of cutting edges are simultaneously contactable with a surface upon which the cutting element is restable.

62 Claims, 6 Drawing Sheets

(56) References Cited

U.S. PATENT DOCUMENTS

| | | | |
|---|---|---|---|
| 2011/0203856 | A1 | 8/2011 | Lynde et al. |
| 2011/0308865 | A1 | 12/2011 | Stroud et al. |
| 2012/0073880 | A1 | 3/2012 | Lynde |

OTHER PUBLICATIONS

Cutting & Wear Website, "Cutting Inserts," http://www.cwuk.com/page390.asp; accessed Jan. 5, 2010.

Notification of Transmittal of the International Search Report and the Written Opinion of the International Searching Authority; PCT/US2011/023698; Korean International Patent Office; Mailed Sep. 27, 2011; ISR 5 pages; WO 3 pages.

Notification of Transmittal of the International Search Report and the Written Opinion of the International Searching Authority; PCT/US2013/039393; Korean International Patent Office; Mailed Sep. 17, 2013; 13 pages.

* cited by examiner

CUTTING ELEMENT AND METHOD OF ORIENTING

BACKGROUND

Cutting tools, such as mills used in downhole applications, for example, can be made with a plurality of cutting elements that are adhered to a surface of a tool. The cutting elements can be randomly shaped particles made by fracturing larger pieces. Alternately, cutting elements can be precisely formed into repeatable shapes using processes such as machining and molding, for example. Regardless of the process employed to make the individual cutting elements the elements are typically adhered to the mill with random orientations. These random orientations create disparities in maximum heights relative to a surface of the mill. Additionally, large disparities may exist between the heights of the portions of the cutting elements that engage the target material during a cutting operation. Furthermore, angles of cutting surfaces relative to the target material are randomized and consequently few are near preferred angles that facilitate efficient cutting. Apparatuses and methods to lessen the foregoing drawbacks would therefore be well received in the industry.

BRIEF DESCRIPTION

Disclosed herein is a cutting element. The cutting element includes, a gilmoid with a plurality of cutting edges thereon, and at least one support extending from the gilmoid, the at least one support and at least one of the plurality of cutting edges are simultaneously contactable with a surface upon which the cutting element is restable.

Further disclosed herein is a method of orienting a cutting element. The method includes, configuring the cutting element so that gravitational forces acting thereon against a surface bias the cutting element to an orientation relative to the surface in which at least one support and at least one side of a polygon of a gilmoid contact the surface.

Further disclosed herein is a cutting element. The cutting element includes, a body having a portion configured as a polygonal prism that is longitudinally asymmetrically weighted with respect to the portion, a plurality of cutting edges defined at intersections of surfaces of the polygonal prism, and at least one support extending longitudinally beyond the portion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
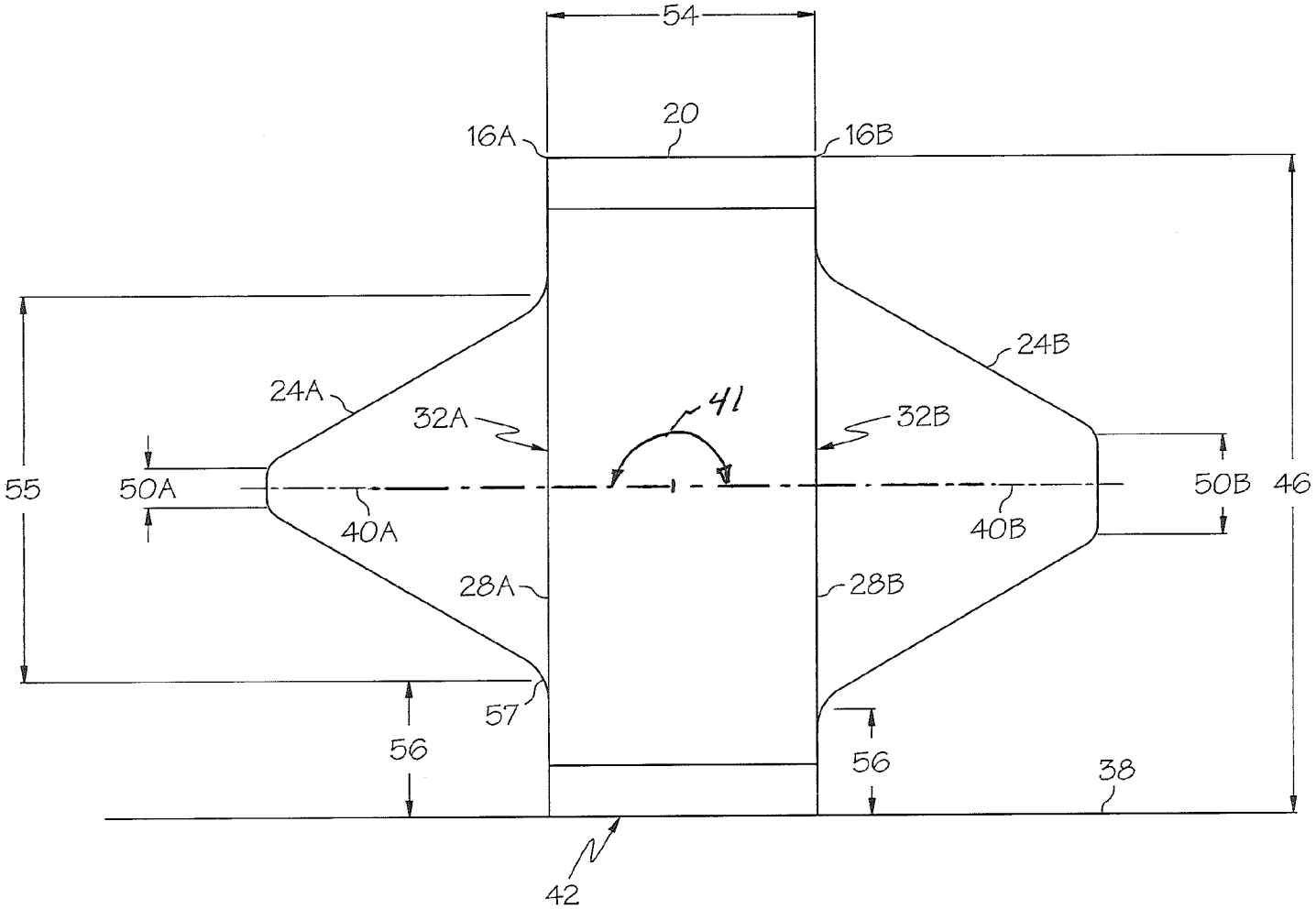
FIG. 1 depicts a side view of a cutting element disclosed herein.

Referring to FIG. 1, an embodiment of a cutting element disclosed herein is illustrated at 10. The cutting element 10 includes, a central portion 20 disclosed herein as a gilmoid, as will be described in detail below with reference to FIGS. 5 and 6, defining a plurality of cutting edges 16A, 16B, and two supports 24A and 24B that extend beyond surfaces 32A and 32B that define certain volumetric boundaries of the gilmoid 20. In this embodiment the supports 24A and 24B are not symmetrical to one another to produce a biasing force in response to gravity acting thereon toward a surface 38, such that one of the supports 24A, 24B and one of the cutting edges 16A, 16B are in contact with surface 38. Additionally, the supports 24A, 24B in this embodiment have a pyramidal shape.

Figure 2:
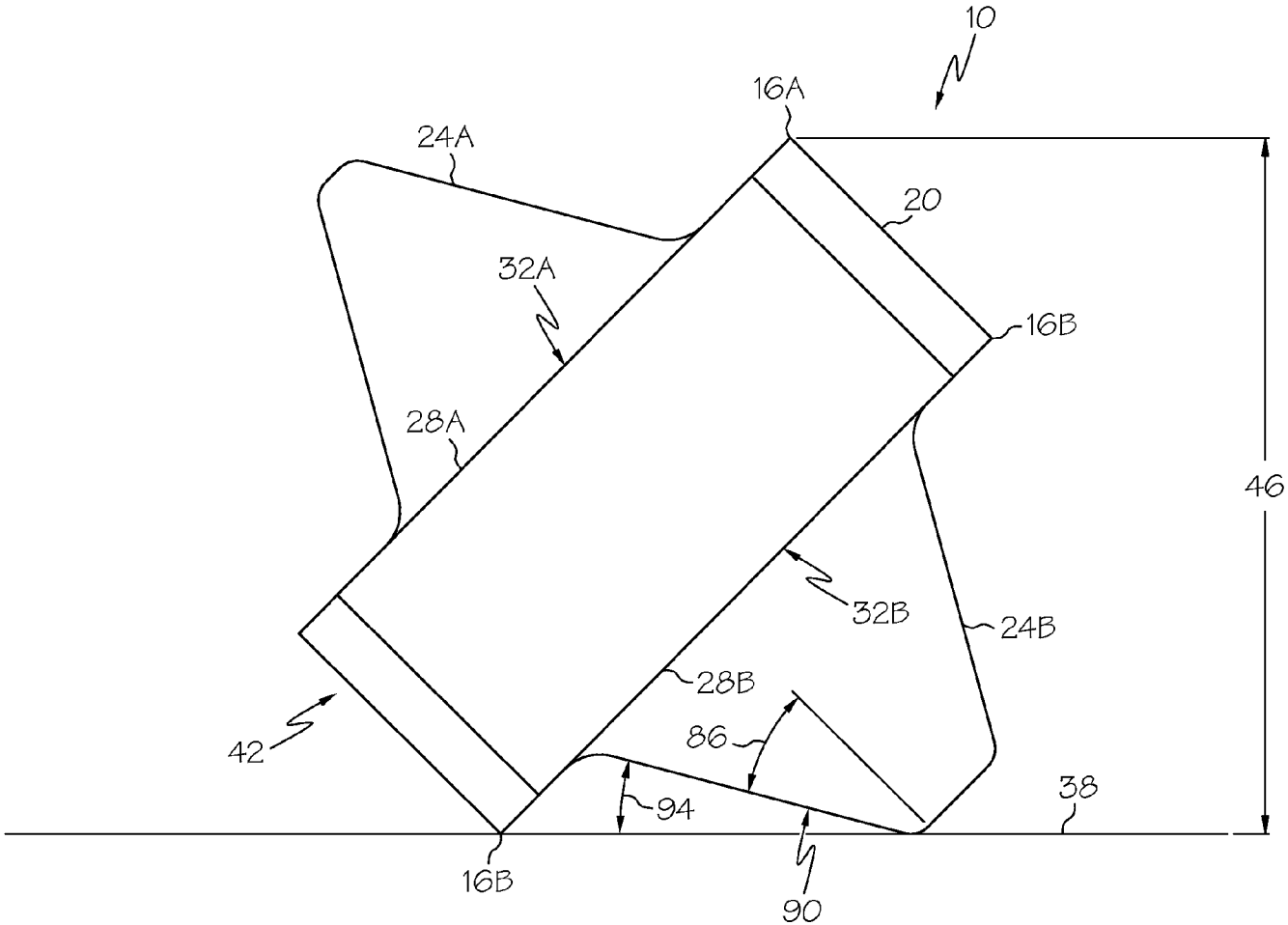
FIG. 2 depicts another side view of the cutting element of FIG. 1, shown resting at an alternate orientation on a surface.
Figure 3:
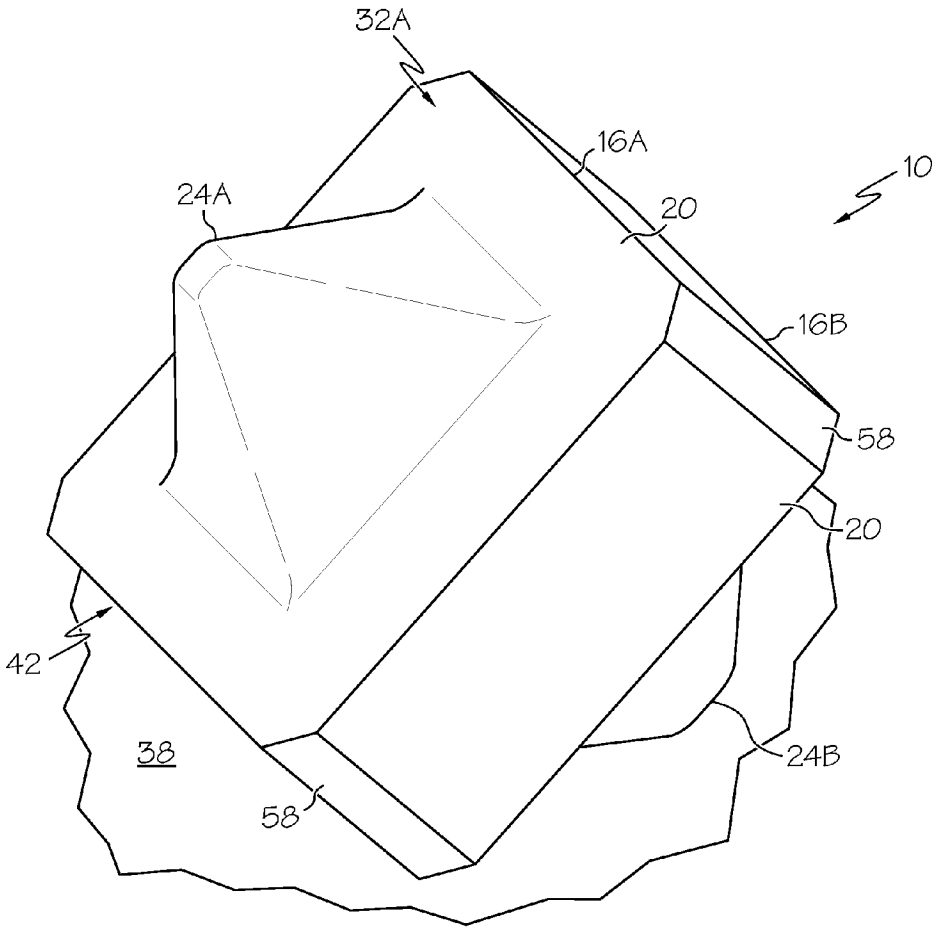
FIG. 3 depicts a perspective view of the cutting element of FIGS. 1 and 2, shown resting at the orientation of FIG. 2.

Referring to FIGS. 2 and 3, the biasing forces tend to cause the cutting element 10 to reorient from the position illustrated in FIG. 1 to the position illustrated in FIGS. 2 and 3. The cutting element 10, as illustrated in FIGS. 2 and 3, is resting on the surface 38 such that both the support 24B and one of the cutting edges 16B is in contact with the surface 38. The cutting edges 16A, in this position, are oriented with the surface 32A at an approximately 45 degree (and preferably between 35 and 55 degrees) angle relative to the surface 38, and represent a preferred cutting orientation that can cut with greater efficiency than alternate angles. In contrast, the cutting element 10 in FIG. 1 is positioned such that just one face 42, defined between the two cutting edges 16A and 16B, is in contact with the surface 38. In this position a longitudinal axes of the gilmoid 20 is substantially parallel with the surface 38. Additionally, although axes 40A, 40B of the supports 24A, 24B are illustrated herein with an angle 41 of 180 degrees between them, angles of 120 degrees or more are contemplated.

The cutting element 10 is further geometrically configured so that when the cutting element 10 is resting on the surface 38, regardless of its orientation, a dimension 46 to a point on the cutting element 10 furthest from the surface 38 is substantially constant. This assures a relatively even distribution of cutting forces over a plurality of the cutting elements 10 adhered to the surface 38.

The foregoing structure allows a plurality of the cutting elements 10 to be preferentially oriented on the surface 38 prior to being fixedly adhered to the surface 38. While orientations of each of the cutting elements 10 is random in relation to a direction of cutting motion the biasing discussed above orients a majority of the cutting elements 10 as shown in FIGS. 2 and 3 relative to the surface 38. Having a majority of the cutting elements 10 oriented as shown in FIGS. 2 and 3 improves the cutting characteristics of a cutter employing these cutting elements 10 over cutters employing non-biasing cutting elements.

The supports 24A and 24B illustrated herein are geometrically asymmetrical, as is made obvious by the difference in widths 50A and 50B of the supports 24A and 24B, respectively. This asymmetry creates the asymmetrical bias discussed above in response to gravitational forces acting on the cutting element 10 in a direction parallel to the surfaces 32A, 32B. Alternate embodiments are contemplated that have supports that are geometrically symmetrical while providing the asymmetrical bias with gravity. A difference in density between such supports is one way to create such an asymmetrical gravitational bias with geometrically symmetrical supports.

A width 54 of the central portion 20, defined between the planes 28A and 28B, can be set large enough to provide strength sufficient to resist fracture during cutting while being small enough to allow the gravitational asymmetrical bias on the cutting element 10 to readily reorient the cutting element 10 relative to the surface 38 and be effective as a cutting element.

Additionally in this embodiment, by making a base dimension 55, defined as where the supports 24A, 24B intersect with the surfaces 32A, 32B, smaller than the dimension 46, a right angled intersection is defined at the cutting edges 16A, 16B. A distance 56 between an intersection 57 of the supports 24A, 24B with the surfaces 32A, 32B and the faces 42, 58, 62 provides a space where the material being cut can flow and can create a barrier to continued propagation of a crack formed in one of the cutting edges 16A, 16B beyond the intersections 57. Preferably, the base dimension 55 is sized to be between 40 and 80 percent of the dimension 46 and more preferably about 60 percent. The 40 to 80 percent requirement combined with the 35 to 55 degree angle limitation discussed above results in flank angle 86 values of between about 15.6 and 29 degrees wherein the flank angle 86 is defined as the angle between a flank face 90 and an axis of the support that is substantially perpendicular to the at least one plane 32B. Additionally, the flank face 90 forms an angle 94 of between about 19.4 and 26 degrees relative to the surface 38.

Figure 4:
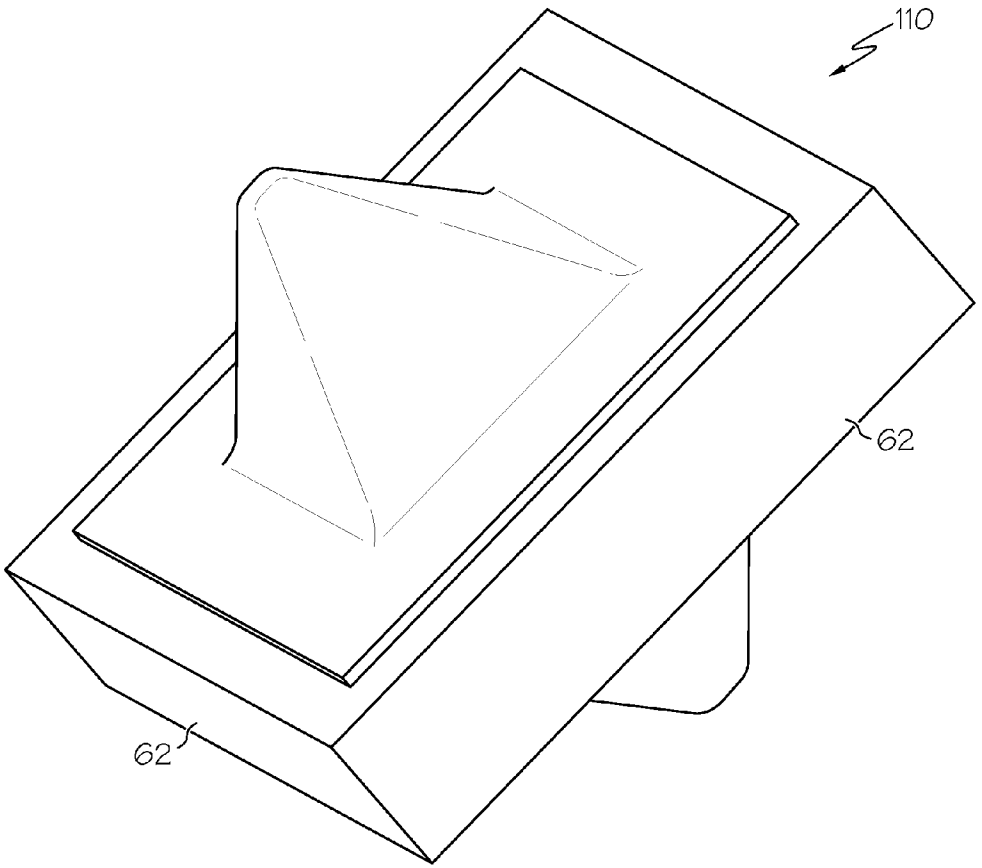
FIG. 4 depicts a perspective view of an alternate embodiment of a cutting element disclosed herein.

Referring to FIG. 3, additional faces 58 defined between the cutting edges 16A and 16B can be incorporated as well. In fact, any number of faces 42, 58 can be provided between the cutting edges 16A and 16B thereby forming a polygonal prism of the central portion 20, including just four faces 62 as illustrated in FIG. 4 in an alternate embodiment of a cutting element 110 disclosed herein.

The cutting elements 10, 110 disclosed herein may be made of hard materials that are well suited to cutting a variety of materials including, for example, those commonly found in a downhole wellbore environment such as stone, earth and metal. These hard materials, among others, include steel, tungsten carbide, tungsten carbide matrix, polycrystalline diamond, ceramics and combinations thereof. However, it should be noted that since polycrystalline diamond is not a required material some embodiments of the cutting elements 10, 110 disclosed may be made of hard materials while excluding polycrystalline diamond therefrom.

Figure 6:
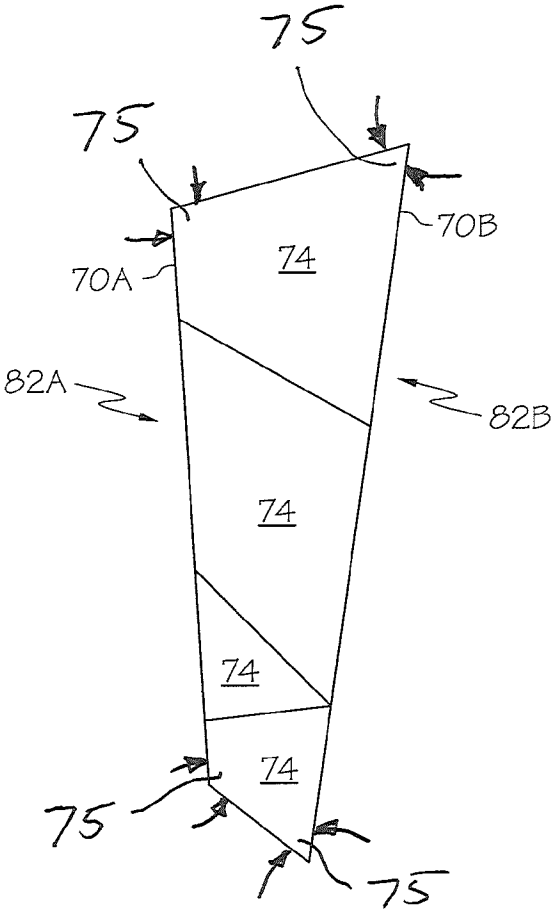
FIG. 6 depicts a side view of the central portion of the cutting element of FIG. 5.
Figure 5:
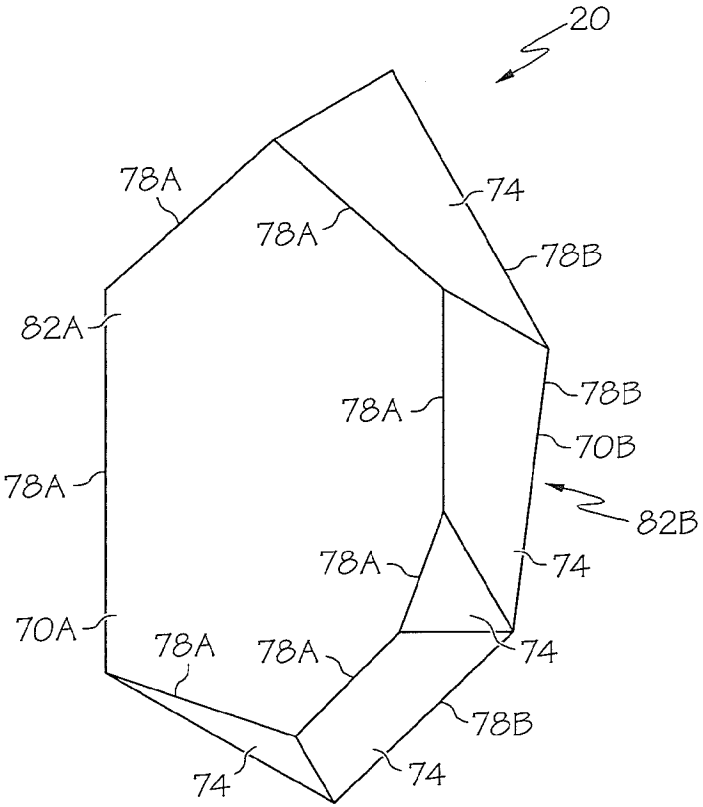
FIG. 5 depicts a perspective view of a central portion of the cutting element.

Although the embodiments discussed above are directed to a central portion 20 that is a polygonal prism, alternate embodiments can incorporate a central portion 20 that has fewer constraints than is required of a polygonal prism. As such, the term gilmoid has been introduced to define the requirements of the central portion 20. Referring to FIGS. 5 and 6, the gilmoid 20 is illustrated without supports 24A, 24B shown. The gilmoid 20 is defined by two polygons 70A, 70B with surfaces 74 that connect sides 78A of the polygon 70A to sides 78B of the other polygon 70B. The two polygons 70A, 70B can have a different number of sides 78A, 78B from one another, and can have a different area from one another. Additionally, planes 82A, 82B, in which the two polygons 70A, 70B exist, can be parallel to one another or can be nonparallel to one another, as illustrated. In embodiments wherein the planes 70A and 70B are not parallel to one another such as is shown in FIG. 6, included angles 75 between the surfaces 74 and the planes 70A and 70B can be in a range of about 80 to 100 degrees.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Figure 7:
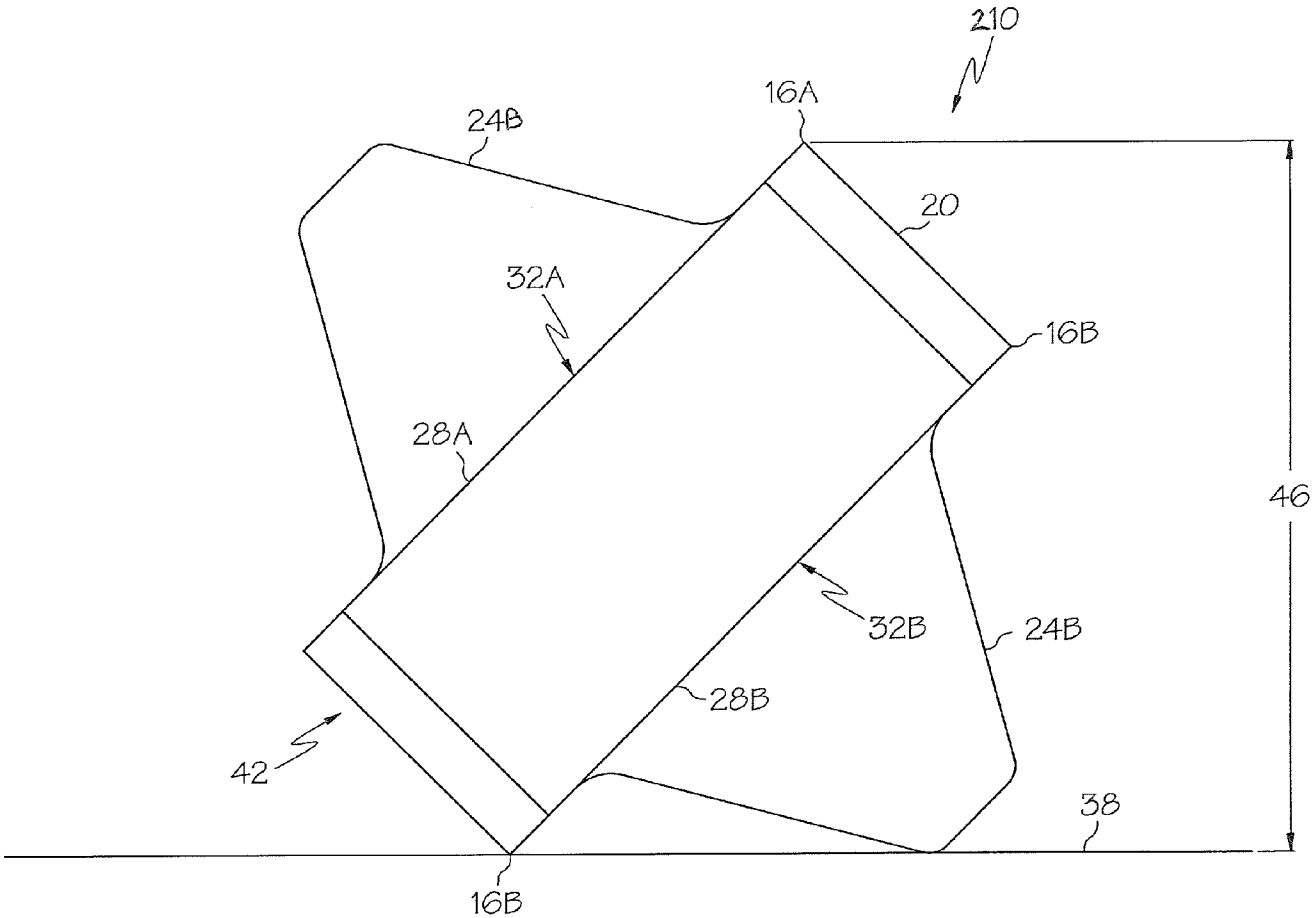
FIG. 7 depicts a side view of an alternate embodiment of a cutting element disclosed herein.

Referring to FIG. 7, an alternate embodiment of a cutting element disclosed herein is illustrated at 210. Many of the characteristics of the element 210 are similar to the element 10 and as such like features are numbered alike and are not described again hereunder. Unlike the element 10, however, the element 210 includes two supports 24B that extend from opposing surfaces 32A and 32B of the gilmoid 20. The two supports 24B are dimensioned the same as one another thereby making the cutting element 210 symmetrical. An embodiment wherein the supports 24A and 24B (shown is FIG. 2) may be geometrically symmetrical is also described above with reference to FIG. 2.

What is claimed:

1. A cutting element comprising:

a gilmoid defining a plurality of edges formed by intersections of surfaces of the gilmoid; and at least one support extending from a plane of the gilmoid the plane being defined as one of the surfaces of the gilmoid from which the at least one support extends, the at least one support and at least one of the plurality of edges being simultaneously contactable with a support surface upon which the cutting element is restable under the force of gravity alone such that the plane of the gilmoid from which at least one of the at least one support extends forms an angle of between about 35 to 55 degrees relative to the support surface.

2. The cutting element of claim 1, wherein the cutting element is configured to orientationally bias the cutting element against the support surface so that at least one of the plurality of edges and one of the at least one support are in contact with the support surface in response to gravity urging the cutting element toward the support surface.

3. The cutting element of claim 1, wherein the support surface is planar.

4. The cutting element of claim 1, wherein the at least one support is two supports and each of the two supports extend from one of two polygons of the gilmoid.

5. The cutting element of claim 4, wherein the two polygons are parallel to one another and the two supports are asymmetrical relative to the two polygons.

6. The cutting element of claim 5, wherein weight of the cutting element is distributed asymmetrically relative to the two polygons.

7. The cutting element of claim 4, wherein the two polygons are similar to one another.

8. The cutting element of claim 4, wherein the plurality of edges are disposed at sides of the two polygons.

9. The cutting element of claim 4, wherein each of the two supports have a base that intersects with one of the two polygons and the bases encompass between 40 and 80 percent of radial dimensions that define each of the two polygons.

10. The cutting element of claim 9, wherein the bases encompass about 60 percent of radial dimensions that define the two polygons.

11. The cutting element of claim 4, wherein the two supports extend in directions such that an angle between axes of the supports is at least 120 degrees.

12. The cutting element of claim 1, wherein the cutting element is made of at least one of steel, tungsten carbide, tungsten carbide matrix, polycrystalline diamond, ceramics and combinations thereof.

13. The cutting element of claim 1, wherein the plurality of edges include substantially right angled corners.

14. The cutting element of claim 1, wherein a dimension to a point on the cutting element furthest from the support surface upon which the cutting element is resting is substantially the same whenever the gilmoid is in contact with the support surface.

15. The cutting element of claim 1, wherein the gilmoid is a polygonal prism.

16. The cutting element of claim 1, wherein the at least one support is two supports and the two supports are symmetrical about a symmetrical gilmoid such that the cutting element is symmetrical.

17. The cutting element of claim 16, wherein the one of the two supports positioned further from the support surface when the one of the two supports contactable with the support surface and the at least one of the plurality of edges of the gilmoid are both in contact with the support surface has a portion that is positioned substantially equal distance from the support surface as an edge of the gilmoid that is furthest from the support surface and can cut material that the one of the two supports comes into contact with.

18. The cutting element of claim 16, wherein the two supports have a pyramidal shape and a base of the supports where the supports attach to the planes have a dimension of about 40 to 80 percent of lateral dimensions of the planes.

19. The cutting element of claim 1, wherein the gilmoid is defined in part by two polygonal surfaces and one of the polygonal surfaces is in the plane from which the at least one support that is contactable with the support surface extends and the other polygonal surface from which the at least one support that is contactable with the support surface does not extend is in a plane that forms an angle of between about 35 and 55 degrees to the support surface.

20. The cutting element of claim 1, wherein at least some of the edges of the gilmoid are cutting edges.

21. A cutting element comprising:

a body having a portion configured as a polygonal prism with two polygonal faces being longitudinally asymmetrically weighted with respect to the portion;

a plurality of edges formed by intersections of the two polygonal faces and other faces of the polygonal prism; and at least one support extending from at least one of the two polygonal faces such that when both the at least one support and one of the plurality of edges are in contact with a support surface due to gravity alone the at least one of the two polygonal faces from which the at least one support extends forms an angle of about 35 to 55 degrees relative to the support surface.

22. The cutting element of claim 21 wherein the at least one support is two supports with each of the two supports extending asymmetrically from each of the two polygonal faces of the polygonal prism.

23. The cutting element of claim 21 wherein the at least one support is configured to orient right angle intersections between the two polygonal faces and the other faces of the polygonal prism at substantially about 45 degree angles relative to the support surface.

24. A cutter tool comprising:

a support surface;

a plurality of cutting elements disposed at the support surface with a plurality of the plurality of cutting elements comprising;

a gilmoid defining a plurality of edges formed by intersections of surfaces of the gilmoid; and at least one support extending from a plane of the gilmoid the plane being defined as one of the faces of the gilmoid from which the at least one support extends, the at least one support and at least one of the plurality of edges being simultaneously contactable with the support surface upon which the cutting element is restable under the force of gravity alone such the plane of the gilmoid from which at least one of the at least one support extends forms an angle of between about 35 to 55 degrees relative to the support, surface.

25. The cutter tool of claim 24, wherein at least one other of the plurality of edges is not in contact with the support surface and is a cutting edge.

26. The cutter tool of claim 25, wherein the at least one other of the plurality of edges is positioned further from the support surface than any other portion of the cutting element.

27. The cutter tool of claim 24, wherein a flank face of the at least one support that is in contact with the support surface has a flank angle of between about 15.6 and 29 degrees wherein the flank angle is defined as the angle between the flank face and an axis of the support that is substantially perpendicular to the at least one plane.

28. The cutter tool of claim 27, wherein the flank face forms an angle of between about 19.4 and 26 degrees relative to the support surface.

29. The cutter tool of claim 27, wherein the cutting elements are symmetrical such that an edge of the cutting element that is positioned furthest from the support surface forms similar angles relative to the support surface.

30. The cutter tool of claim 29, wherein the edge positioned furthest from the support surface is configured to cut material anticipated to be in an earth formation borehole including stone, earth and metal.

31. A method of removing material in a wellbore with the cutter tool of claim 24, comprising:

contacting a plurality of the plurality of cutting elements with an object within a wellbore selected from the group consisting of stone, earth and metal; and cutting the object with the plurality of the plurality of cutting elements.

32. A cutting element comprising:

a gilmoid defining a plurality of edges formed by intersection of surfaces of the gilmoid; and at least one support extending from a plane of the gilmoid the plane being defined as one of the faces of the gilmoid from which the at least one support extends, the at least one support and at least one of the plurality of edges being simultaneously contactable with a support surface upon which the cutting element is restable under the force of gravity alone such that the plane of the gilmoid from which at least one of the at least one support extends forms an angle of between about 35 to 55 degrees relative to the support surface, the cutting element being made of materials other than polycrystalline diamond.

33. An apparatus for drilling subterranean formations, comprising:

a support surface;

a plurality of cutting elements for placement on the support surface, wherein the plurality of cutting elements include a base having a peripheral upper end edge and a peripheral lower end edge wherein the lower end edge engages the support surface and the peripheral upper end edge is disposed at a distance from the support surface, the base having at least one lateral support extending therefrom such that random placement of the plurality of cutting elements on the support surface results in at least some of the plurality of cutting elements being positioned such that the peripheral lower end edge and the associated at least one lateral support is simultaneously in contact with the support surface at spaced locations on the support surface, a plane being defined as a surface of the base from which the at least one lateral support extends forming an angle between about 35 and 55 degrees with the support surface when the base and the at least one lateral support are in contact with the support surface.

34. The apparatus of claim 33, wherein the at least one lateral support comprises at least two lateral supports and each of the two lateral supports extend from opposing sides of the base.

35. The apparatus of claim 34, wherein the opposing sides of the base are parallel and the at least two lateral supports are asymmetrical relative to the opposing sides to which the at least two lateral supports are mounted.

36. The apparatus of claim 35, wherein weight of the plurality of cutting element is distributed asymmetrically relative to the opposing sides.

37. The apparatus of claim 34, wherein the at least two lateral supports are substantially symmetrical.

38. The apparatus of claim 34, wherein the peripheral upper end edge and the peripheral lower end edge are cutting edges.

39. The apparatus of claim 34, wherein a radial dimension of a contact location of the at least two lateral supports to the base comprises between 40 and 80 percent of the radial dimension of the base.

40. The apparatus of claim 39, wherein the radial dimension of the contact location of the at least two lateral supports to the base comprises about 60 percent of the radial dimension of the base.

41. The apparatus of claim 34, wherein the at least two lateral supports extend in directions such that an angle between axes of the at least two lateral supports is at least 120 degrees.

42. The apparatus of claim 34, wherein: the at least two lateral supports have a pyramidal shape wherein a lower end of the pyramidal shape at the base comprises a dimension of 40 to 80 percent of the lateral dimension of the base.

43. The apparatus of claim 33, wherein the base is made of at least one of steel, tungsten carbide, tungsten carbide matrix, polycrystalline diamond, ceramics and combinations thereof.

44. The apparatus of claim 33, wherein the peripheral upper end edge and the peripheral lower end edge include substantially right angled corners.

45. The apparatus of claim 33, wherein the base comprises a polygonal prism.

46. The apparatus of claim 33 wherein:

the at least one lateral support has a flank face at an angle of between about 15.6 and 29 degrees with respect to an axis of the at least one lateral support.

47. The apparatus of claim 46, wherein:

the flank face is disposed at an angle of between about 19.4 and 26 degrees with respect to an axis of the at least one lateral support.

48. The apparatus of claim 46, wherein:

the plurality of cutting elements are symmetrical such that an edge of the plurality of cutting elements that is positioned furthest from the support surface forms similar angles relative to the support surface.

49. The apparatus of claim 48, wherein:

the edge positioned furthest from the surface cuts material including at least one of stone, earth and metal.

50. The apparatus of claim 33, wherein:

the plane is at least one of parallel opposed polygonal surfaces of the base.

51. The apparatus of claim 33, wherein:

the base and the at least one lateral support comprising, steel, tungsten carbide, tungsten carbide matrix, ceramics and combinations including at least one of the foregoing, excluding polycrystalline diamond.

52. The apparatus of claim 33, wherein:

the support surface is planar.

53. The apparatus of claim 33, wherein:

distribution of the plurality of cutting elements on the support surface in a random orientation results in at least one point on the peripheral upper end edge of the base being substantially a constant distance from the support surface.

54. The apparatus of claim 53, wherein:

the at least one point on the peripheral upper end edge of the base is substantially a constant distance from the support surface in which the at least one lateral support is in contact.

55. The apparatus of claim 54, wherein:

all points on the peripheral upper end edge of the cutting elements are at the constant distance from the support surface in which the at least one lateral support is in contact.

56. The apparatus of claim 33, wherein:

the peripheral upper end edge and the peripheral lower end edge are disposed on a cube shape having opposing sides where the opposing sides define a quadrilateral or polygonal shape.

57. The apparatus of claim 56, wherein:

the opposing sides are parallel.

58. The apparatus of claim 33, wherein:

the peripheral lower end edge and the peripheral upper end edge define an included angle of between about 80 and 100 degrees.

59. A plurality of cutting elements configured for placement on a support surface, the plurality of cutting elements comprising:

a base having a peripheral upper end edge and a peripheral lower end edge wherein the peripheral lower end edge engages the support surface and the peripheral upper end edge is disposed at a distance from the support surface, the base having at least one lateral support extending therefrom such that random placement of the plurality of cutting elements on the support surface results in at least some of the peripheral lower end edges and associated lateral supports being simultaneously in contact with the support surface at spaced locations on the support surface, a plane being defined as a surface of the base from which the at least one lateral support extends forming an angle between about 35 and 55 degrees with the support surface when the base and the at least one lateral support are in contact with the support surface.

60. The plurality of cutting elements of claim 59, wherein:

distribution of the plurality of cutting elements on the support surface in a random orientation results in at least one point on the peripheral upper end edges of the bases being substantially a constant distance from the support surface.

61. The apparatus of claim 60, wherein:

the at least one point on the peripheral upper end edges of the bases are substantially a constant distance from the support surface for all the plurality of cutting elements in which the lateral support is in contact with the support surface.

62. The apparatus of claim 61, wherein:

all points on the peripheral upper end edges of the plurality of cutting elements are at the constant distance from the support surface in which the lateral supports are out of contact with the support surface.

* * * * *